United States Patent [19]

Miyoshi

[11] Patent Number: 4,822,023

[45] Date of Patent: Apr. 18, 1989

[54] PAPER-FEEDING DEVICE

[75] Inventor: Yoshitake Miyoshi, Osaka, Japan

[73] Assignee: Mita Industrial Co., Ltd., Osaka, Japan

[21] Appl. No.: 113,378

[22] Filed: Oct. 27, 1987

Related U.S. Application Data

[63] Continuation of Ser. No. 868,049, May 29, 1986, abandoned.

[30] Foreign Application Priority Data

Jul. 29, 1985 [JP] Japan ..... 60-116760

[51] Int. Cl.[4] ..... B65H 3/06

[52] U.S. Cl. ..... 271/118; 271/122; 271/125; 271/167

[58] Field of Search ..... 271/125, 124, 122, 121, 271/118, 117, 167, 104, 137

[56] References Cited

U.S. PATENT DOCUMENTS 1,256,975 2/1918 Bigelow et al. ..... 271/122 X
4,360,263 11/1982 Miyoshi et al. ..... 355/29
4,526,358 7/1985 Ura et al. ..... 271/124
4,552,353 11/1985 Tanaka et al. ..... 271/124
4,556,209 12/1985 Tsubo ..... 271/122 X

FOREIGN PATENT DOCUMENTS 2518310 11/1976 Fed. Rep. of Germany ..... 271/124
52832 4/1980 Japan ..... 271/117
189944 11/1982 Japan ..... 271/122

*Primary Examiner*—Joseph J. Rolla
*Assistant Examiner*—David H. Bollinger
*Attorney, Agent, or Firm*—Wenderoth, Lind & Ponack

[57] ABSTRACT

A position controlling member for controlling the leading ends of paper sheets housed in a paper receiving member is provided at a free end thereof with an auxiliary double feed preventing member having large friction factor or force and engaging with a lower side of a paper sheet during return movement thereof to a position controlling position thereof, thereby preventing double feeding of paper sheets without interfering with the paper feeding operation.

4 Claims, 5 Drawing Sheets

PAPER-FEEDING DEVICE

This application is a continuation of now abandoned application Ser. No. 868,049, filed May 29, 1986, now abandoned.

BACKGROUND OF THE INVENTION

1. Field of the Invention

The present invention relates to a paper feeding device for feeding manuscripts and copying paper sheets in an image recording apparatus such as a copying machine.

2. Description of the Prior Art

A known such paper feeding device is shown in FIGS. 9, 10 and includes a paper housing member 21 for housing a plurality of paper sheets P in layers. A position controlling means 22 for controlling the positions of leading ends of the paper sheets P is mounted adjacent member 21 so as to be movable to a control-released state only in the first stage of a paper feeding operation by pivoting in a downstream direction with respect to a paper feeding direction. A paper supply roller 27 feeds the uppermost paper sheet P during a paper feeding operation. An upper feed roller 26 and a lower feed roller 26 grasp and convey the thus fed paper sheet P from paper housing member 21 and are located at a position midway along a paper feeding path. A paper feeding roller 23 rotating in the paper feeding direction and a separating roller 24 rotating in a direction opposite to the paper feeding direction are provided to separate a paper sheet beneath the topmost paper sheet which might be fed therewith and to prevent conveyance thereof by rollers 25, 26. Rollers 23, 24 are located upstream in the paper feeding direction with respect to feed rollers 25, 26.

According to the above described construction, advantages occur in that even though the paper housing member 21 is supplied carelessly with the paper sheets P, the leading ends of paper sheets P are caused to be positioned in the correct orientation by the position controlling means 22, so that the paper sheets can be stably fed, even when two paper sheets P are fed simultaneously by the paper feeding roller 23. The lower thus fed paper sheet P is subjected to the action of separating roller 24 in the direction opposite to the paper feeding direction, so that the simultaneous feeding of two paper sheets effectively is prevented. When feeding the top paper sheet P by the feed rollers 25, 26, paper feeding roller 23 and separating roller 24 are spaced from each other (solid lines in FIG. 10), so that the paper feeding force to be applied by the feed rollers 25, 26 can be reduced and the generation of static electricity due to frictional contact between the paper sheet P and paper feeding roller 23 and separating roller 24 can be suppressed.

However, when the paper feeding roller 23 and separating roller 24 are spaced from each other while the paper sheet P is being conveyed by feed rollers 25, 26, the double feed preventing function of the separating roller 24 is lost. Thus, two paper sheets can be fed simultaneously, thereby producing jamming. Even when jamming is not produced, nevertheless, in the case where a manuscript is the object, an image of two pieces of the manuscript, which is in a shifted condition, can be copied on two recording paper sheets, half and half. In the case where a copying paper is the object, an image of a manuscript can be copied on two shifted pieces of copying paper, half and half.

SUMMARY OF THE INVENTION

The object of the present invention is to avoid the above described disadvantages and to surely prevent the double feeding of paper sheets by a simple improvement effectively utilizing the basic already provided machine components.

In order to achieve the above described object according to the present invention, the position controlling means is provided with an auxiliary double feed preventing member having large friction factor or force and engaging with a lower side of a paper sheet during a return movement thereof to a position controlling state thereof.

The present invention was developed by consideration of the fact that the position controlling means, which already is provided, moves away from the paper feeding path during a first stage of the paper feeding operation and makes a return movement to a position controlling position when the paper feeding roller and the separating roller are relatively separated from each other. The double feeding of paper sheets can be surely prevented without interference with the paper feeding operation by efficiently utilizing the motion of the position controlling means and only by adding an auxiliary double feed preventing member.

BRIEF DESCRIPTION OF THE DRAWINGS

Preferred embodiments of the present invention are described below, with reference to the accompanying drawings, in which.

DESCRIPTION OF THE PREFERRED EMBODIMENTS

Figure 1:
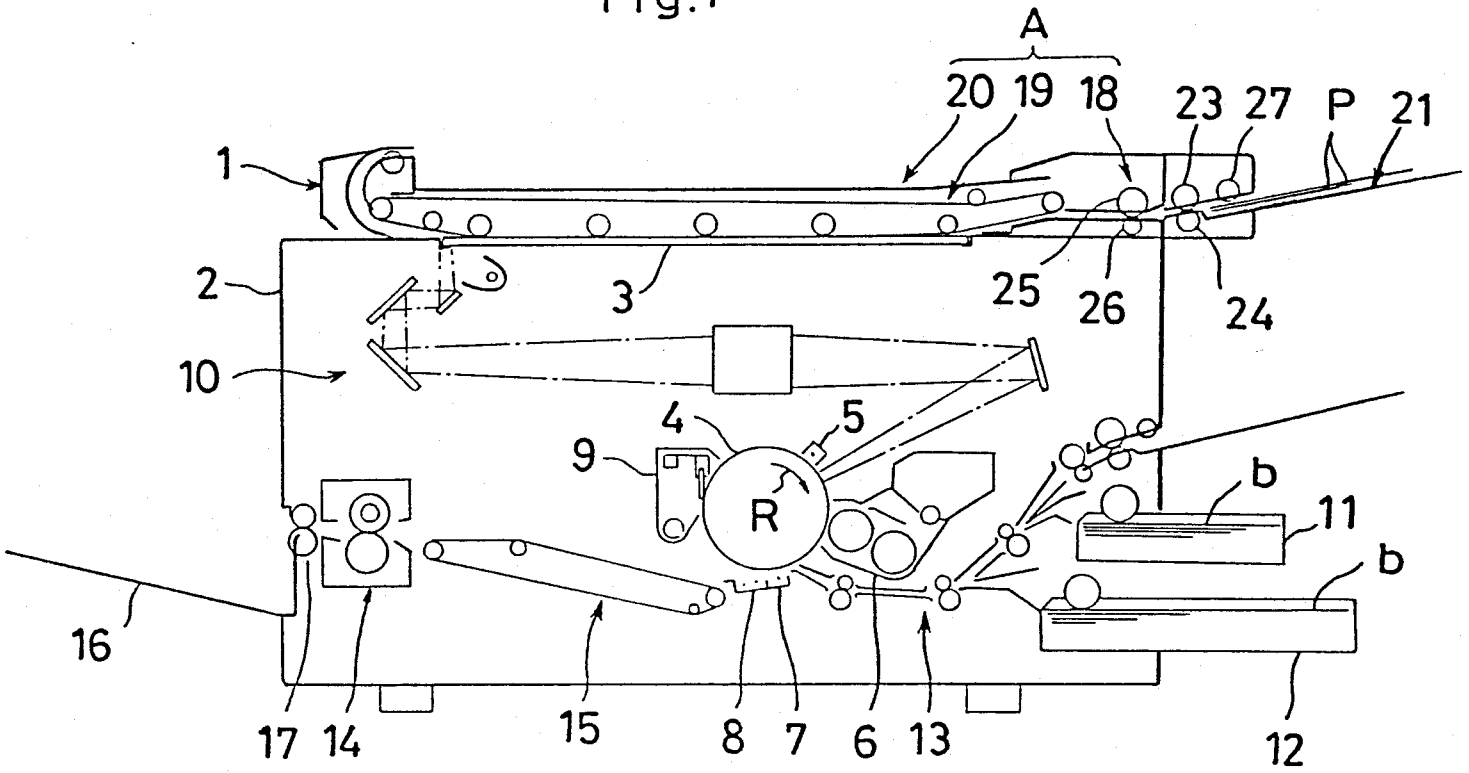
FIG. 1 is a schematic longitudinal sectional view showing a copying machine.

Referring now to FIG. 1, which is a schematic sectional view of an electrostatic photographic copying machine, a cover 1 for pressing a manuscript and including an automatic feed mechanism A for feeding a manuscript P therein is arranged so as to be swingable and closable relative to an upper contact glass 3 of a body 2 of the copying machine. Body 2 has therein a photoreceptor 4 and a charging device 5, a developing device 6, a transfer device 7, a paper separating device 8 and a cleaning device 9 are arranged around photoreceptor 4 in the rotary direction of photoreceptor 4 in this order. An exposure device 10 of a movable optical system is arranged in a space above photoreceptor 4. A paper feeding and conveying device 13 feeds the transfer device 7 with recording or copying papers 6 housed in cassette cases 11, 12. A paper discharging and conveying device 15 feeds a fixing device 14 with the recording papers b after separating thereof from photoreceptor 4. Paper discharging rollers 17 discharge the recording papers b into a tray 16.

Automatic copy paper feeding mechanism A comprises a paper feeding device 18, a belt type conveying device 19 for feeding to contact glass 3 objects P, such as paper sheets or a manuscript, drawn from paper feeding device 18 at a predetermined position of contact glass 3, and a stock portion 20 for storing the manuscript P after it is copied.

Figure 2:
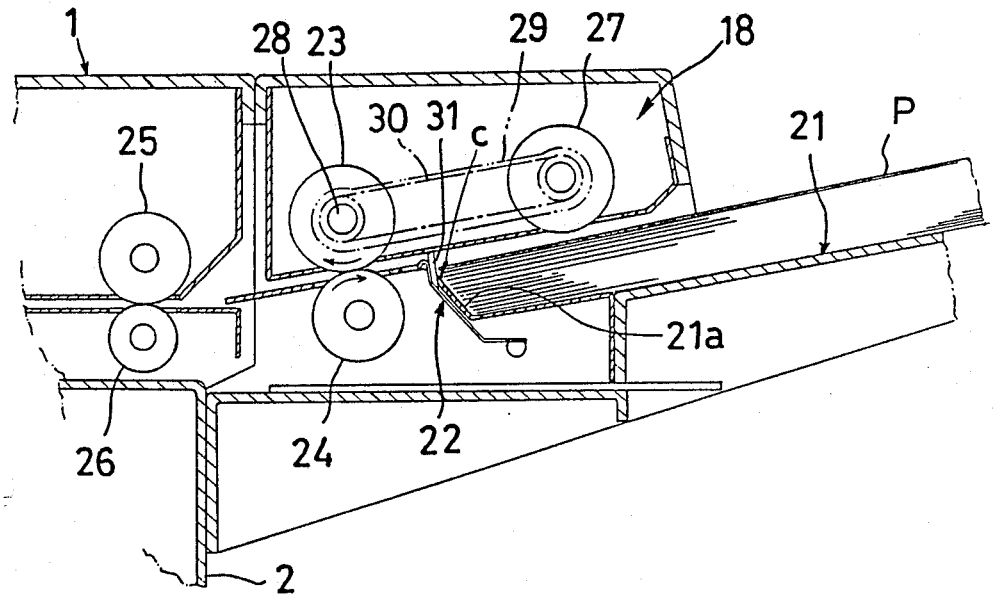
FIG. 2 is a detailed sectional view of a paper feeding device of the invention.

Paper feeding device 18 is shown in detail in FIG. 2. Reference numeral 21 designates a paper receiving member capable of housing a large number of manuscript sheets P in layers therein. A downstream end portion 21*a* of paper receiving member 21, with respect to the paper feeding direction, is provided with an opening c through which extends a free end of a position controlling means 22.

Position controlling means 22 controls the positions of leading ends of sheets P within paper receiving member 21, and is reciprocally pivotably mounted to be swingable in the paper feeding direction and thus be changed over to a control released state only during the first stage of a paper feeding operation.

Reference numeral 23 designates a paper feeding roller and 24 designates a separating roller having a friction factor smaller than that of paper feeding roller 23, both rollers 23, 24 being arranged downstream of position controlling means 22 in the paper feeding direction and midway along a paper feeding path of sheets P from paper receiving member 21. Paper feeding roller 23 can be rotated in the paper feeding direction, while the separating roller 24 is rotated in a direction opposite to the paper feeding direction.

A pair of feed rollers including an upper feed roller 25 and a lower feed roller 26 are arranged downstream of paper feeding roller 23 and separating roller 24 in the paper feeding direction.

Separating roller 24 is adapted to be moved downwardly from paper feeding roller 23 (alternatively, the paper feeding roller 23 may be moved upwardly) while a sheet P is conveyed by feed rollers 25, 26 and grasped therebetween.

Reference numeral 27 designates a paper supply roller mounted on an end of a bracket 29 which is swingable about an axis corresponding to rotation axis 28 of paper feeding roller 23. Roller 27 is driven synchronously with paper feeding roller 23 by a transmission mechanism 30 and is adapted to be engaged with an uppermost manuscript sheet P housed in paper receiving member 21 only during a first stage of a paper feeding operation to feed rollers 23, 24 with uppermost sheet P.

Figure 3:
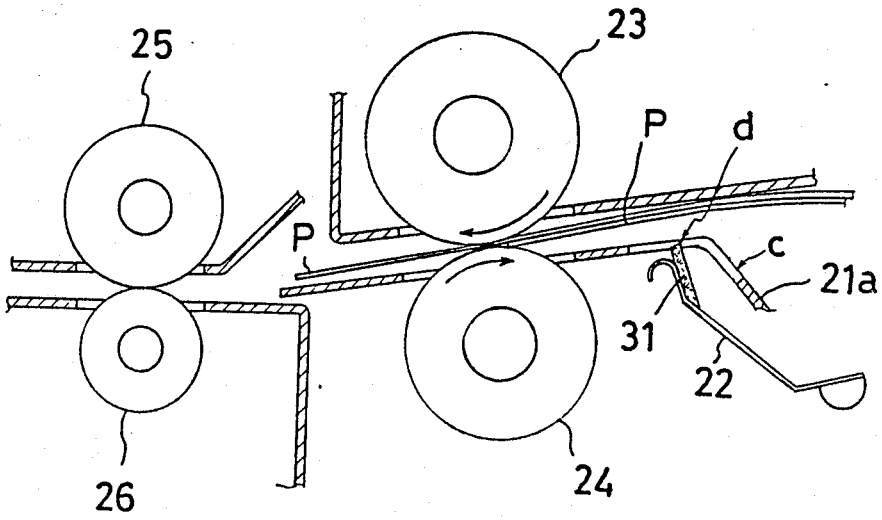
FIGS. 3, 4 are diagrams showing a double feed preventing mechanism of the invention.

A paper feeding signal causes the position controlling means 22 to move to the control released position and lowers paper supply roller 27 to a paper feeding position, thereby feeding the paper feeding roller 23 and the separating roller 24 with the uppermost manuscript sheet P housed in the paper receiving member 21. Successively, the paper supply roller 27 is lifted. At this time, sometimes a second manuscript sheet P is drawn out together with the uppermost manuscript sheet P. However, as shown in FIG. 3, second sheet P can be prevented from being fed together with the uppermost sheet P by the separating roller 24 rotating in a direction opposite to the paper feeding direction.

Figure 6:
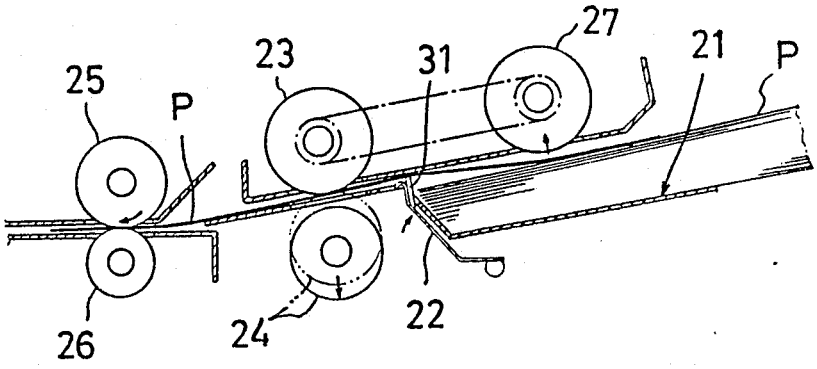
Figure 7:
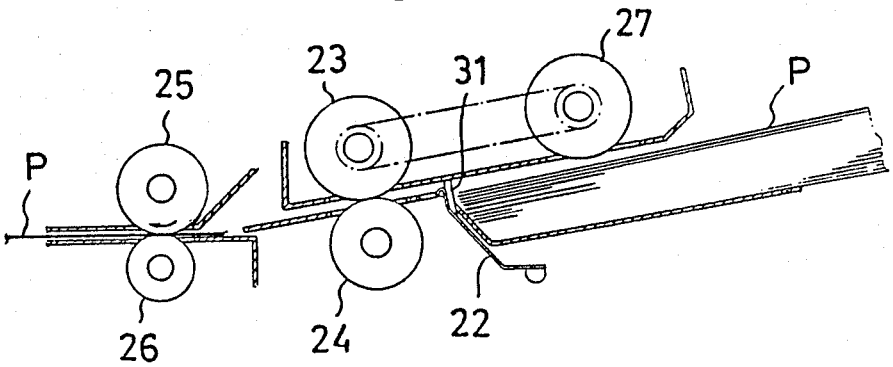

When, as shown in FIG. 6, the sheet P, which is being subjected to a paper feeding and conveying force by the paper feeding roller 23, reaches the nip between the pair of feed rollers 25 and 26 and is held therebetween, separating roller 24 is lowered to separate from the paper feeding roller 23, thereby achieving a reduction of the paper feeding force and the prevention of generation of static electricity. As shown in FIG. 7, the separating roller 24 again is lifted when the rear end of the sheet P has passed the position of facing portions of rollers 23, 24. If the second manuscript sheet P was drawn out together with the uppermost manuscript sheet P, as above described, such second sheet P is fed together with the uppermost sheet P conveyed by rollers 25, 26 while separating roller 24 is separated from the paper feeding roller 23.

Figure 4:
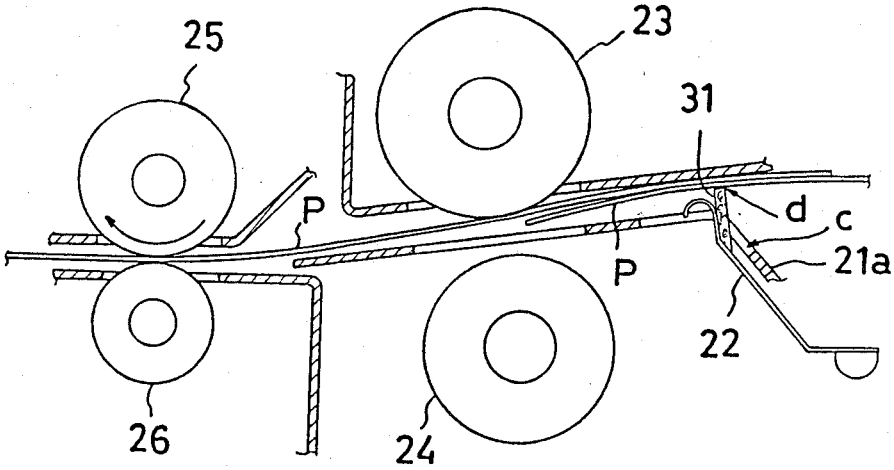
Figure 5:
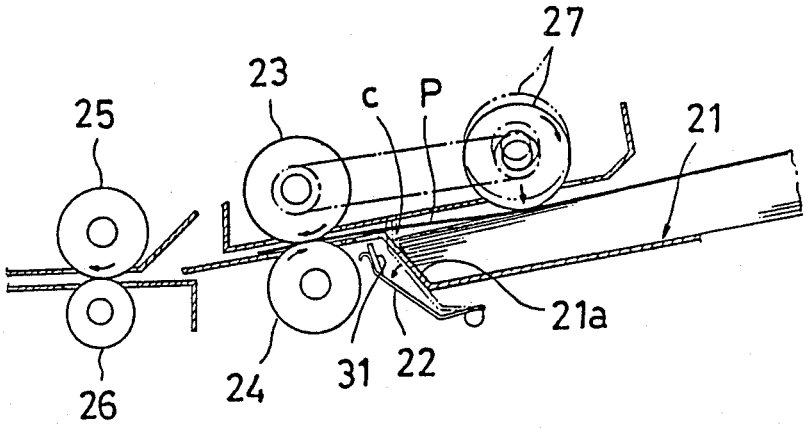
FIGS. 5 to 7 are views showing use of the paper feeding mechanism.

Therefore, in accordance with the present invention the second sheet P is prevented from being fed by the provision on the free end of position controlling means 22 with an auxiliary double feed preventing member 31 having a large frictional resistance. That is to say, auxiliary double feed preventing member 31 is a thin plate or sheet made of, for example, urethane rubber adhered to a surface of the position control or paper sheet abutting side of the free end of the position controlling means. Member 31 has a projecting pointed end edge d extending beyond the swinging free end of position controlling means 22 to engage with the lower side of the lower sheet P when position controlling means 22 is moved from the control released state (shown in FIG. 3) back to the blocking position (shown in FIG. 4) after the first stage of paper feeding operation. The friction produced when the end edge d of auxiliary double feed preventing member 31 engages with the lower side of the second sheet P separates such second sheet P from the fed uppermost sheet and prevents the second sheet from being fed with the uppermost sheet.

Figure 8:
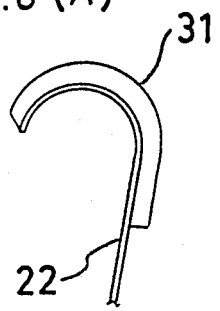
FIGS. 8(A) and 8(B) are side views showing another embodiment of the double feed preventing member of the invention.
Figure 8:
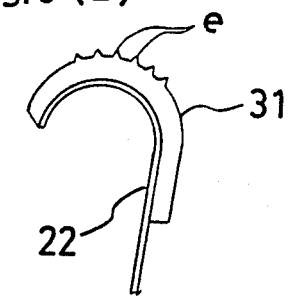
Figure 9:
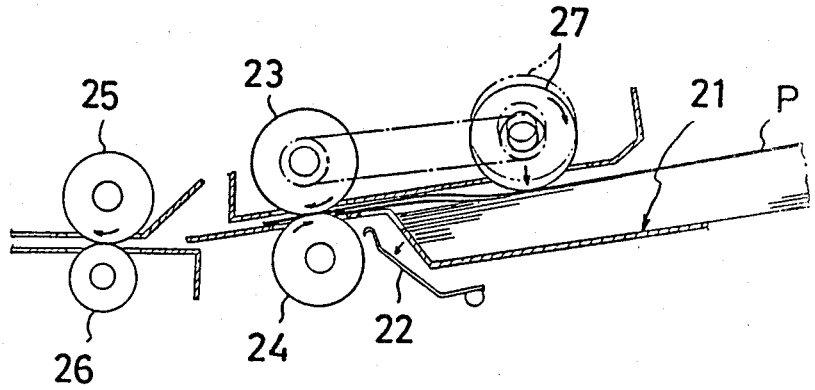
Fig.9 (PRIOR ART)
FIGS. 9, 10 are sectional views showing a conventional device.
Figure 10:
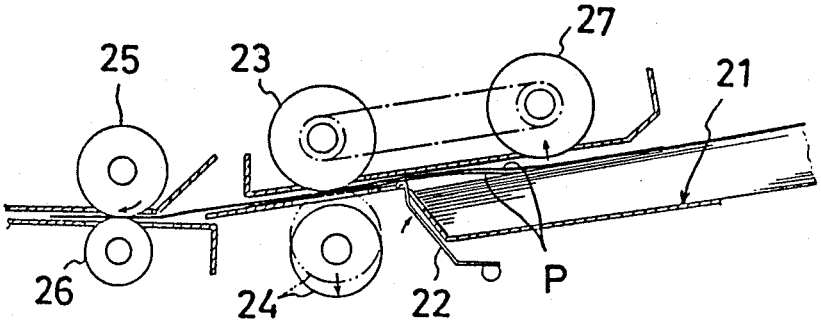
Fig.10 (PRIOR ART)

Auxiliary double feed preventing member 31 preferably has end edge d engaged with the lower side of the second sheet P, but an end surface portion of the auxiliary double feed preventing member 31 may be engaged with the lower side of the second sheet P. Alternatively, as shown in FIG. 8(A), the auxiliary double feed preventing member 31 may be wound around a free end surface of the position controlling means 22 to present a curved surface, or, as shown in FIG. 8(B), the auxiliary double feed preventing member 31 wound around the position controlling means 22 additionally may be provided with small projections e on the outside curved surface thereof.

In addition, although the manuscript P is an object to be fed in the above described embodiment, the paper feeding device 18 according to the present invention may be installed in a manual paper feeding portion of a copying machine when using recording paper as objects to be fed. That is to say, the present invention is not restricted with regard to the type of object to be fed.

What is claimed is:

1. In a paper feeding device for supplying sheets one at a time from a stack of paper sheets, said device including a paper receiving member for housing therein a plurality of paper sheets in a stack, paper supply roller means for feeding an uppermost paper sheet of the stack in a feed direction along a feed path, a pair of paper feed rollers positioned downstream of said supply roller means for receiving therefrom the uppermost paper sheet and for conveying such uppermost paper sheet in said feed direction, position controlling means for controlling the positions of leading ends of the paper sheets of the stack in said paper receiving member, said position controlling means comprising a member mounted adjacent a forward end of said paper receiving member for pivotal movement, during each operation of feeding by said paper supply roller means of an uppermost paper sheet from the stack, between a blocking first position, whereat said member blocks the leading ends of the paper sheets of the stack, and a release second position, whereat said member is spaced away from the leading ends of the paper sheets of the stack, said member having an upper end pivoting generally downstream with respect to said feed direction during movement of said member from said first position thereof to said second position thereof and pivoting generally upstream with respect to said feed direction during movement of said member from said second position thereof to said first position thereof, separating means positioned between said supply roller means and said pair of feed rollers for separating from the uppermost paper sheet any paper sheets therebeneath and supplied therewith by said supply roller means and thereby for preventing the simultaneous supply of plural paper sheets to said pair of paper feed rollers, said separating means comprising an upper feeding roller rotated in said feed direction and a lower separating roller rotation in a direction opposite to said feed direction, said upper feeding roller and said lower separating roller being positioned toward each other to nip therebetween the uppermost paper sheet and any paper sheets therebeneath and supplied from said supply roller means such that rotation of said separating roller in said opposite direction prevents feeding to said pair of feed rollers of any paper sheets other than the uppermost paper sheet, and said upper feeding roller and said lower separating roller being spaced from each other in a separated position to not nip therebetween the uppermost paper sheet and any paper sheets therebeneath upon the uppermost sheet being supplied to said pair of feed rollers, the improvement comprising auxiliary separating means for preventing the simultaneous supply of plural paper sheets when said upper feeding roller and said lower separating roller are spaced from each other in said separated position, said auxiliary separating means comprising:

friction means mounted on said upper end of said member of said position controlling means and pivotal therewith for, upon said member pivoting from said second position thereof to said first position thereof, engaging the lower side of any paper sheet beneath the uppermost paper sheet and fed by said paper supply roller means and preventing any further advance thereof in said feed direction.

2. The improvement claimed in claim 1, wherein said friction means comprises a sheet of friction material fixed to said member and having an upper end extending above said upper end of said member.

3. The improvement claimed in claim 1, wherein said friction means comprises a curved element of friction material attached to said upper end of said member.

4. The improvement claimed in claim 3, wherein said curved element has a paper contacting surface having projections extending therefrom.

* * * * *